US007533504B2

(12) United States Patent
Johnson

(10) Patent No.: US 7,533,504 B2
(45) Date of Patent: May 19, 2009

(54) CABLE MECHANISM

(75) Inventor: Bruce D. Johnson, Bloomington, MN (US)

(73) Assignee: Window Support Systems, Inc., Bloomington, MN (US)

( * ) Notice: Subject to any disclaimer, the term of this patent is extended or adjusted under 35 U.S.C. 154(b) by 724 days.

(21) Appl. No.: 10/894,509

(22) Filed: Jul. 20, 2004

(65) Prior Publication Data

US 2006/0016147 A1 Jan. 26, 2006

(51) Int. Cl.
*E04C 5/08* (2006.01)

(52) U.S. Cl. ..... 52/223.13; 403/34

(58) Field of Classification Search ..... 403/34; 52/698, 705, 706; 411/392, 402; 172/419, 172/427

See application file for complete search history.

(56) References Cited

U.S. PATENT DOCUMENTS 1,985,509 A * 12/1934 Lemont ..... 403/209
2,317,248 A * 4/1943 Brickman ..... 256/13.1
2,710,570 A * 6/1955 Wellsch ..... 172/186
3,156,018 A * 11/1964 Slayter ..... 52/73
3,219,373 A * 11/1965 Sutliff ..... 403/34
4,079,556 A * 3/1978 Luck et al. ..... 52/127.2
5,349,878 A * 9/1994 White et al. ..... 74/89.14
6,158,310 A * 12/2000 Goss et al. ..... 81/121.1
2005/0246978 A1 * 11/2005 Johnson ..... 52/202

* cited by examiner

*Primary Examiner*—Richard E Chilcot, Jr.
*Assistant Examiner*—Jessica Laux
(74) *Attorney, Agent, or Firm*—Clayton R. Johnson

(57) ABSTRACT

The cable mechanism includes an elongated flexible cable that has one end portion adapted for being attached to a supporting structure, for example, the exterior surface of a building by a cleat or clamp, and an opposite end portion mounted to one end portion of an axially elongated stud. The stud has an axial intermediate threaded portion while the end portion opposite the mounting of the cable is polygonal in transverse cross section. Fasteners such as a nut and washer may be provided on the stud in an axially adjusted position to at least aid in supporting, for example, the lower surface of a bay window in a leveled condition while the cable is attached to a building by a clamp or cleat.

6 Claims, 1 Drawing Sheet

CABLE MECHANISM

BACKGROUND OF THE INVENTION

This invention relates to cable mechanism permitting an adjustment in its effective length for at least aiding in supporting structure, for example bay and bow windows of a house.

At the present time there is cable mechanism that is mountable to a house and has a slot in the terminal end of a cable stud to facilitate making an adjustment in the effective length of a cable to support structure, for example a bay or a bow window at a desired elevation and/or in a leveled condition.

In order to provide improved cable mechanism that is mountable to structure, for example a building, and is usable for making an adjustment to adequately tension and/decrease the effective length of cable mechanism to at least partially support structure, for example bay and bow windows, at a given elevation and/or a level condition this invention has been made.

SUMMARY OF THE INVENTION

The cable mechanism includes an elongated cable that at one end is joined to an end of an axially elongated stud having an intermediate threaded portion and an end portion opposite the cable that is polygonal in transverse cross section.

An object of this invention is to provide new and novel cable mechanism for at least partially supporting structure such as a bay or bow window and permitting easily making an adjustment to obtain a desired elevation and/or leveling of such windows.

DESCRIPTION OF THE PREFERRED EMBODIMENT

Figure 3:
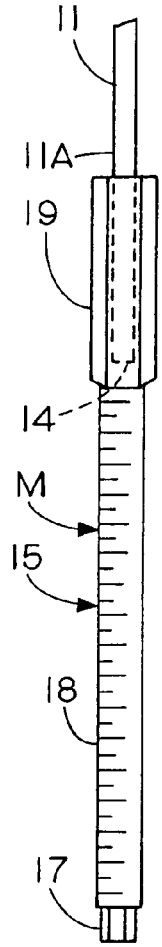
FIG. 3 is an enlarged fragmentary view of the stud end portion of the cable mechanism.

Referring to the drawings, and in particular to FIG. 3, there is shown cable mechanism of this invention, generally designated M, that includes an elongated flexible cable 11 which may be made of twisted metal strands. One end portion 11A of the cable is extended into an axial bore 14 in one end portion 19 of an axially elongated metal stud, generally designated 15. The cable is suitably joined to the stud while extending in the stud bore, for example by a swaging operation.

The opposite end portion 17 of the stud is of a polygonal shape in transverse cross section that has transversely opposite parallel edges, preferably hexagonal or rectangular. The intermediate portion 18 of the stud which extends between the stud end portions is threaded with the crest diameter of the threads being greater than the maximum transverse dimension of the polygonal end portion of the end portion 17. The threaded intermediate portion of the stud has a single continuous peripheral helical thread extending at least a major part of the axial length of the stud and desirably substantially from one end of the intermediate portion to the other. Advantageously, the axial length of the stud threaded portion is greater than the combined axial lengths of the stud end portions.

Figure 1:
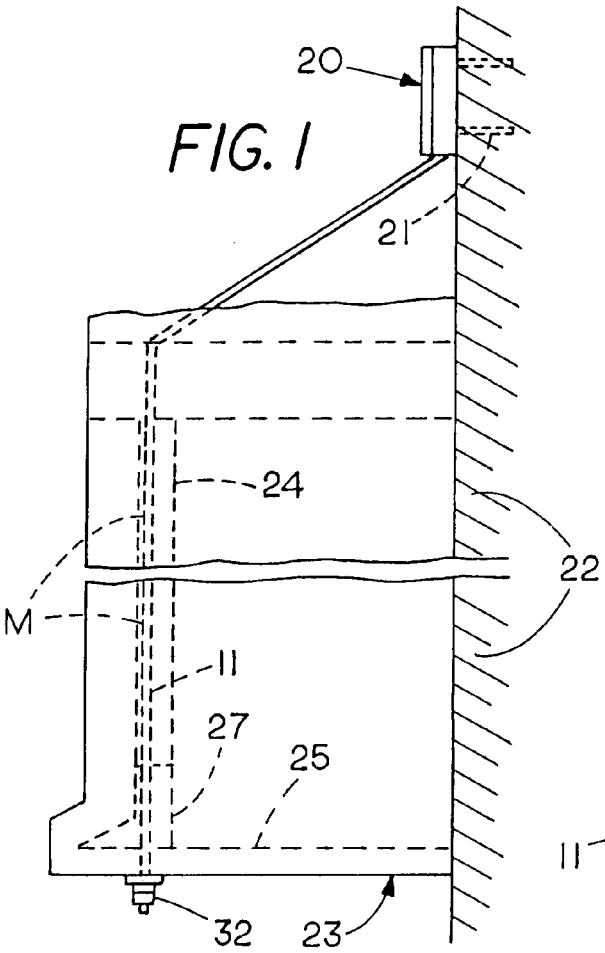
FIG. 1 is a somewhat diagrammatic showing of the use of the cable mechanism of this invention for supporting a bay window, only parts of the bay window being shown.

As an example of using the cable mechanism of this invention and referring in particular to FIG. 1, there is diagrammatically shown a conventional cleat or clamp, generally designated 20, mounted by nails or screws 21 to supporting structure such as an exterior wall 22 or to an overhanging part (not shown) of a building, for example a house, above a bow or a bay window, generally designated 23, which is generally shown in outline other than for the dotted line showing of a mullion 24 and a seat board 25 of the window. The mullions 24 are remote from the house exterior wall.

Figure 2:
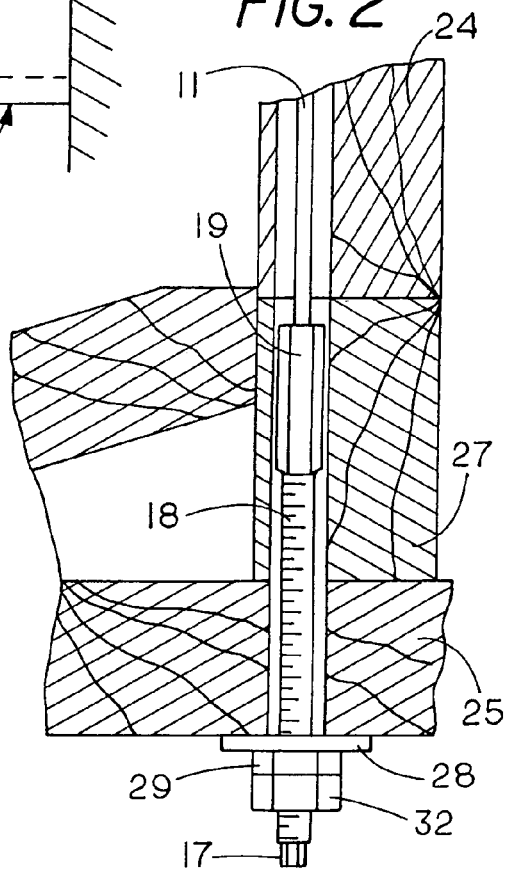
FIG. 2 is an enlarged, fragmentary cross sectional view of a lower portion of a bay window and the cable mechanism with the cable mechanism in supporting relationship to a lower portion of the bay window.
Figure 4:
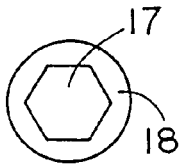
FIG. 4 is an end view of the stud terminal end portion of the cable mechanism.

The end portion of the cable 11 remote from the stud is laced to the cleat or clamped while its intermediate portion is extended downwardly through a mullion 24 to have the stud extend downwardly through bores in the window frame member 27 and the seat board 25 (see FIG. 2). The cable is of a length to have the lower part of the stud threaded portion and the stud end portion 17 located below the bottom surface of the seat board. Advantageously, a washer 28 is moved to have the stud end portion 17 extend therethrough and into abutting relationship to the bottom surface of the seat board and a nut 29 is moved to have the stud end portion extend into the nut and thence threaded on the stud intermediate portion to retain the washer in abutting relationship to the seat board bottom surface. The minimum diameter of the nut is sufficiently greater it may be moved to be threaded to the threaded portion without having to contact the end portion 17. It is to be understood that even though it is not preferred, the washer may be eliminated and the nut 29 abut against the bottom surface of the seat board. Wrenches (not shown) may be utilized to sufficiently thread the nut 29 on the stud threaded portion to result in the cable being tensioned to aid in supporting the bay or bow window at the desired elevation and/or leveled condition. With reference thereto, as a result of the end portion 17 being of a polygonal shape, a wrench may be readily used to prevent the stud being rotated as another wrench is used to rotate the nut 29 to further thread the nut on the stud. Thereafter, a lock nut 32 may be threaded on the stud to prevent unintended unthreading of the nut 29.

By further threading the nut on the stud, the effective length of the cable mechanism that aids in supporting the window is decreased. This results in the adjacent portion of the window being elevated and/or leveled the desired amount and acts to prevent sagging of the supported part of the bay or bow window. The effective length of the cable mechanism is that part extending from the cleat or clamp to that part on which the nuts are threaded after making the threadingly adjustment.

What is claimed is:

1. For aiding in supporting from a supporting structure, one of a bay window and a bow window that has a mullion, a frame member and a seat board with a bottom surface in at least one of a level condition and at a desired elevation from the structure, cable mechanism that includes an elongated cable having a first end portion adapted for being mounted to the supporting structure and a second end portion and an elongated stud having a first end portion fixedly attached to the cable second end portion, an axially elongated intermediate portion that is threaded and a second end portion that is polygonal in transverse cross section and a nut with at least one of the nut being threadable on the intermediate portion and a washer on the stud for abutting against the bottom surface, the threaded intermediate portion comprising a single, continuous helical thread extending at least a major part of the intermediate portion with its crest diameter being greater than the maximum transverse dimension of the stud second end portion, the intermediate portion having a lower threaded part with the stud second end portion joined thereto, the lower part and stud second end portion being extendablr below the seat board bottom surface.

2. The cable mechanism of claim 1 wherein the stud first end portion has a hole with the cable second end portion extending therein.

3. The cable mechanism of claim 2 wherein the stud first end portion and the cable second end portion are swagingly fixedly attached to one another.

4. A building, one of a bay window and a bow window, cable mechanism for aiding in supporting from the building and facilitating at least one of leveling and adjusting the elevation of the window, the one of the bay window and the bow window having a mullion, a frame member and a seat board with a bottom surface, the cable mechanism including an elongated cable having a first end portion adapted for being mounted to the building and a second end portion and an elongated stud having a first end portion fixedly attached to the cable second end portion, an axially elongated intermediate portion that is threaded and a second end portion that is polygonal in transverse cross section, the intermediate portion having a maximum thread diameter that is greater than the maximum transverse dimension of the stud second end portion, and a nut with at least one of the nut being threadable on the intermediate portion and a washer on the stud for abutting against the bottom surface, the nut being movable to have the stud second end portion extended therein and being movable relative to the stud second end portion to a position for then being threaded to the stud intermediate portion while being movable out of contact with the stud second end portion, the intermediate portion having a lower threaded part with the stud second end portion joined thereto, the lower part and stud second end portion extending below the seat board bottom surface, and means for attaching the cable first end portion to the building.

5. The cable mechanism of claim 4 wherein the threaded intermediate portion comprises a single, continuous helical thread extending at least a major part of the intermediate portion and the second end portion has transversely opposite parallel edges.

6. The structure of claim 4 wherein the stud first end portion has an axial bore extended therein with the cable second end portion fixedly attached to the stud first end portion and extended in the stud bore.

* * * * *